United States Patent [19]

Cope

[11] 4,357,999

[45] Nov. 9, 1982

[54] RADIAL TRUCK CENTERING BRAKE ASSEMBLY

[75] Inventor: Geoffrey W. Cope, Williamsville, N.Y.

[73] Assignee: Dresser Industries, Inc., Dallas, Tex.

[21] Appl. No.: 210,510

[22] Filed: Nov. 26, 1980

Related U.S. Application Data

[63] Continuation-in-part of Ser. No. 926,764, Jul. 21, 1978, abandoned.

[51] Int. Cl.[3] ..... B61F 3/08; B61F 5/44; B61F 13/36

[52] U.S. Cl. ..... 188/52; 105/168; 105/182 R; 188/212; 188/233.3

[58] Field of Search ..... 105/167, 168, 165, 166, 105/182 R, 199 R, 226; 188/52, 53, 207, 212, 233.3

[56] References Cited

U.S. PATENT DOCUMENTS

| | | | |
|---|---|---|---|
| 2,231,841 | 2/1941 | Mussey | 188/207 |
| 2,422,004 | 6/1947 | Flesch | 188/52 |
| 2,547,860 | 4/1951 | Flesch | 188/233.3 X |
| 3,088,550 | 5/1963 | Kirk | 188/52 |
| 3,482,531 | 12/1969 | Tack | 105/226 |
| 3,789,770 | 2/1974 | List | 105/199 R |
| 4,003,316 | 1/1977 | Monselle | 105/167 |
| 4,114,540 | 9/1978 | Strugielski et al. | 105/226 |
| 4,131,069 | 12/1978 | List | 105/168 |
| 4,147,237 | 4/1979 | Mulcahy | 188/52 |

*Primary Examiner*—Robert B. Reeves
*Assistant Examiner*—Howard Beltran
*Attorney, Agent, or Firm*—Raymond T. Majesko

[57] ABSTRACT

A railroad freight car truck designed for the installation of steering arms for radial tracking in curves and high speed stability, and truck mounted air brake rigging of the standard type utilizing dual push-rods through the bolster to eliminate the truck biasing forces developed by conventional brake rigging with holes for accommodating the push-rods through the bolster and lugs for allowing the steering arms to engage and guide the brake beams in the lateral direction.

5 Claims, 6 Drawing Figures

RADIAL TRUCK CENTERING BRAKE ASSEMBLY

RELATES APPLICATIONS

This is a continuation in part of application Ser. No. 926,764, filed July 21, 1978, now abandoned.

TECHNICAL FIELD

The technical field of this invention is railway car rolling stock. It particularly relates to railway car trucks which are equipped to be self-steering radially.

BACKGROUND OF THE INVENTION

The radial truck of the type known as the DR-1 has been proven to reduce considerably the lateral force on the rail in curves and to greatly improve the stability of the lateral action in high speed tangent track operation, there is however, a further source of truck skew and wheel wear that should be eliminated and that is the truck rotating force developed by truck bolster anchored body mounted brake rigging. This rotative force is the result of a couple produced by the brake top rod pulling the upper end of the truck live lever which is located at a lateral distance from the truck center of rotation, the center plate, and reacts at the bolster via the dead lever fulcrum, also laterally displaced from the center of rotation.

A truck mounted brake assembly which utilizes dual push-rods through the bolster is so designed that all of the braking forces are reacted within the brake rigging and side frames so that no truck rotative forces are developed. However, this brake assembly requires the use of both of the brake rod holes through the truck bolster and since the DR-1 Radial Truck steering arms also require the use of one of the two holes, the two units are incompatible as currently designed.

OBJECTS OF THE INVENTION

An object of the present invention, therefore, is to render the dual push-rod through bolster type air brake assembly and the DR-1 Radial Truck compatible so that they can be utilized together and optimize the lateral tracking efficiency of the resulting truck assembly particularly during brake operation.

A further object is to provide lateral alignment of the brake shoes with the wheel treads to prevent uneven wear of the wheel flanges which is common with conventional trucks and brake rigging including the dual push-rod through bolster type unit.

A more specific object is to provide lateral alignment of the brake shoes with the wheel treads by utilizing the steering arms to laterally guide the brake beams through the use of interdigitating lugs.

Another object of the invention is to achieve compatibility of the dual push-rod through bolster type brake assembly with the Radial Truck system with the least possible change in the basic truck components, and no change to the radial steering arms from the initial DR-1 configuration.

A more specific object is to achieve compatibility by a modification of the truck bolster and the dual push-rod through bolster type brake beam assembly only.

An additional object is to provide an upwardly extending interdigitating lug that can be retrofitted on existing radial trucks with any type of air brake assembly.

SUMMARY OF THE INVENTION

Figure 1:
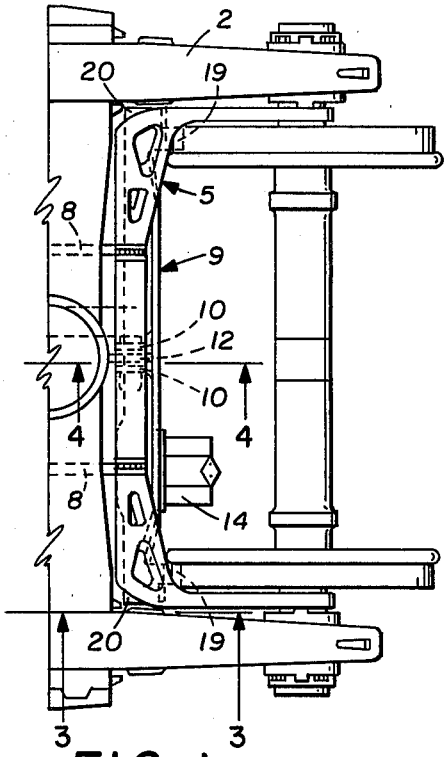
FIG. 1 is a fragmentary plan view of a truck with the steering arm and dual push-rod through bolster type brake assembly in their respective operating positions.
Figure 2:
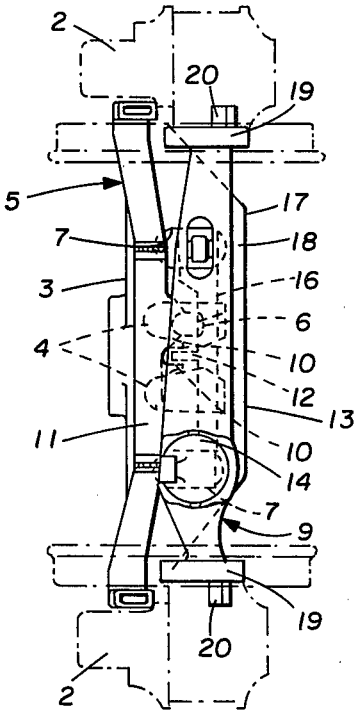
FIG. 2 is a fragmentary end elevation view of the truck of FIG. 1 showing the relationship of the steering arm and the brake assembly.
Figure 4:
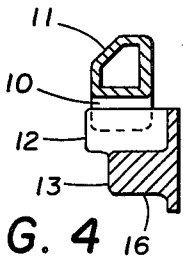
FIG. 4 is an elevation view partly in cross-section taken along lines 4—4 of FIG. 1.
Figure 3:
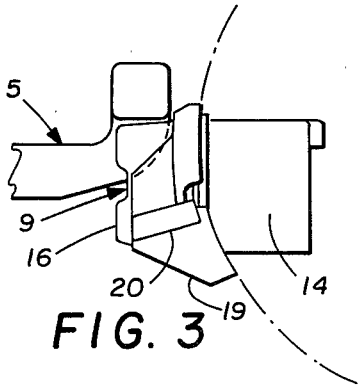
FIG. 3 is an elevation view taken along lines 3—3 of FIG. 1 indicating the minimum clearance between the steering arm and brake cylinder.

In accordance with the present invention, there is provided a railway car truck comprising at least a pair of longitudinally spaced wheelsets composed of axles with spaced apart wheels mounted thereon. Also, there are a pair of steering arm members, one for each axle, having means for rotative mounting on said axles. Each steering arm member extends from its axle to a point substantially midway between the axles when they are pivotally connected by a pivotal connection post on each arm member. There is a through brake assembly having brake beams, operating cylinders and push-rods. The truck bolster, which is resiliently supported on spring groups in side frames, has two centrally located lateral standard openings, one of which is used to accommodate the steering arm posts and the other brake rods. There is an upwardly extending lugs on the brake beams and a downwardly extending sockets on the cross beams of the steering arms for engaging the steering arms with the brake rigging to restrain lateral movement of the brake beams relative to the steering arms.

DETAILED DESCRIPTION OF THE INVENTION

Referring now in detail to FIGS. 1 to 4 in which like reference characters designate like parts, the railroad freight car truck to which the present invention pertains is basically a conventional three-piece truck equipped with steering arms as illustrated in my co-pending applications Ser. Nos. 907,460 and 908,875 thus converted into what is known as a Radial Truck, more specifically a DR-1 Radial Truck as covered by List U.S. Pat. No. 3,789,770.

The truck side frames 2 are of conventional design and receive the bolster 3 in the normal window opening supported on a standard spring group and equipped with state-of-the-art friction snubbers built into the bolster ends and frictionally engaging the side frame column wear plates.

The bolster 3 is provided with the usual brake connecting rod openings 4, one of which is utilized for the steering arm 5 center connector post 6. Two additional through holes 7 are provided equidistant and further from the truck centerline to accommodate the push rods 8 of the dual push-rod through bolster type brake assembly 9. To maintain the required section modulus of the bolster at the holes 7, the lower wall 17 and side walls 18 are adjusted to suit.

The steering arm 5 is identical to that covered in my co-pending application Ser. No. 907,460 with the exception of the lugs 10 which are downstanding from the cross beam 11 to laterally capture the upstanding lug 12 on the brake beam 13, but permit the longitudinal and vertical movement required for operation.

The brake assembly 9 is fundamentally similar to the current design and the operating cylinder 14 and the rod connection 15 are spaced so as to pass the rods 8 through the holes 7 in the bolster to connect to the mating half of the assembly (not shown) on the other side of the bolster 3. The upstanding lug 12 is cast or otherwise formed or made integral with the brake beam 13 to interface with lugs 10 for the purpose of lateral guidance.

The hat shaped section 16 of the brake beam 9 is contoured to pass under the connector post 6 of the steering arm 5 with the necessary operating clearance.

The brake heads 19 and the unit guide lugs 20 are identical to current practice to cooperate with the standard unit guides (not shown) on the side frames in which the beams 9 are supported.

Constructed, as above described and illustrated, the modified bolster, brake assembly and radial steering arms of the present invention can be readily assembled to operate together and in doing so, upgrade a conventional truck performance to provide greatly improved curve negotiation, high speed lateral stability together with non-rotative braking and positive brake shoe alignment.

Despite its capabilities, it will be apparent that the total assembly is simple and rugged in construction and detracts nothing from the integrity of the basic three-piece truck construction which has a very wellproven track record.

Figure 5:
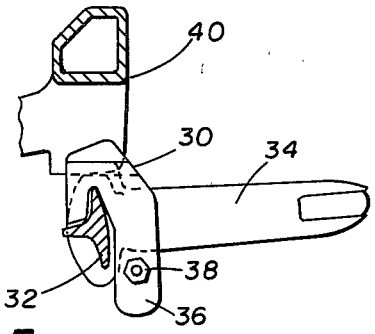
FIG. 5 is a side elevation view, partly in cross-section showing the relationship of the steering arm and the brake assembly with a lug retrofit.
Figure 6:
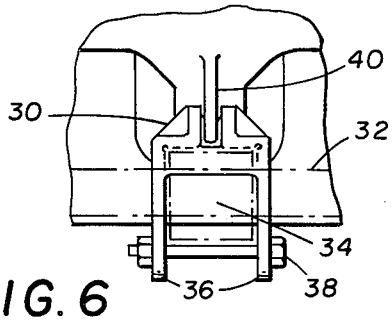
FIG. 6 is a front elevation view of the configuration shown in FIG. 5.

Another aspect of the invention is shown in FIGS. 5 and 6. This construction is utilized for retrofitting existing radial trucks regardless of the type of air brake assembly.

Here, a bifurcated brake beam centering adaptor 30 is applied over the brake beam truss 32 and strut 34 connection and interlocks with the top of the truss member to prevent lateral or longitudinal movement. The adaptor 30 has two downstanding legs 36 which span the strut member 34 and has a bolt 38 passing therethrough to urge the legs 36 together to tighten and secure the adaptor to strut 34. The bifurcated upstanding lug 30 straddles a downstanding lug 40 at the center of the steering arm to control the lateral movement of the brake beam.

It should be understood that the described and disclosed embodiments are merely exemplary of the invention and that all modifications are intended to be included that do not depart from the spirit of the invention and the appended claims.

The embodiments of the invention in which an exclusive property or privilege is claimed are defined as follows:

1. In a railway car truck including a bolster having a pair of centrally located lateral openings and being supported in side frames between vertical spaced columns thereof, a longitudinally spaced wheelset composed of an axle with spaced apart wheels mounted thereon, a "C" shaped steering arm member with two side arms, a cross beam, a downwardly offset connecting post and pivotal connecting means at the extremity of the post, the steering arm member extending from the axle to the bolster where it is pivotally connected by the pivotal connecting means, a brake assembly including a brake beam supported on said side frames, operating cylinder and push rods, the improvement comprising said brake beam having upwardly extending lug means and the cross beam of the steering arm having downwardly extending lug means in interdigitating relationship with said upwardly extending lug means for engaging the steering arm with the brake assembly to restrain lateral movement of the brake beam relative to the steering arm.

2. Truck of claim 1, in which the upwardly extending lug means is bifurcated and is removably fastened to the brake beam.

3. Truck of claim 1, in which the brake beam of the brake assembly has a hat section which is contoured to pass under the connecting post of the adjacent steering arm.

4. Truck of claim 1, in which the brake assembly is a dual push-rod through bolster brake assembly.

5. Truck of claim 4, in which the bolster has at least two additional lateral openings substantially equidistant from the bolster centerline near the ends thereof to accommodate the push rods of said brake assembly.

* * * * *